US012169070B2

(12) United States Patent
Garg et al.

(10) Patent No.: US 12,169,070 B2
(45) Date of Patent: Dec. 17, 2024

(54) DEFLECTOR FOR A COOKING APPLIANCE

(71) Applicant: WHIRLPOOL CORPORATION, Benton Harbor, MI (US)

(72) Inventors: Ankur Garg, Pune (IN); Federico Garuccio, Bresso (IT); Ashish Mittal, Pune (IN); Luca Zilio, Baindronno (IT)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 407 days.

(21) Appl. No.: 17/580,712

(22) Filed: Jan. 21, 2022

(65) Prior Publication Data

US 2023/0235891 A1 Jul. 27, 2023

(51) Int. Cl.
*F24C 15/00* (2006.01)
*F24C 15/02* (2006.01)

(52) U.S. Cl.
CPC ..... *F24C 15/006* (2013.01); *F24C 15/02* (2013.01)

(58) Field of Classification Search
CPC ..... F24C 15/006; F24C 15/00; F24C 15/02
USPC ..... 126/198
See application file for complete search history.

(56) References Cited

U.S. PATENT DOCUMENTS

| | | | | |
|---|---|---|---|---|
| 3,893,442 | A * | 7/1975 | Nuss | F24C 15/04 126/200 |
| 4,716,884 | A * | 1/1988 | Bonaccorsi | F24C 15/04 126/200 |
| 9,677,770 | B2 | 6/2017 | Lee et al. | |
| 2013/0186386 | A1* | 7/2013 | Trautner | F24C 15/006 126/198 |
| 2018/0094820 | A1 | 4/2018 | Verdoliva | |
| 2019/0301746 | A1 | 10/2019 | Catalogne et al. | |

FOREIGN PATENT DOCUMENTS

| | | |
|---|---|---|
| EP | 0947776 | 10/1999 |
| EP | 0964208 | 12/1999 |
| EP | 2444737 | 6/2008 |
| EP | 2278227 | 1/2011 |
| EP | 1936281 | 4/2012 |
| WO | 2018104000 | 6/2018 |
| WO | 2021025276 | 2/2021 |

* cited by examiner

*Primary Examiner* — Avinash A Savani
(74) *Attorney, Agent, or Firm* — PRICE HENEVELD LLP

(57) ABSTRACT

A deflector assembly in a cooking appliance door includes a fin with a directing flange and a projection. The projection extends toward the central panel and is configured to concentrate cool air flow within the channels of the cooking appliance door. The directing flange cooperates with a tab to define a single opening through which the cool air is concentrated and directed toward an upper portion of the cooking appliance door.

17 Claims, 7 Drawing Sheets

DEFLECTOR FOR A COOKING APPLIANCE

BACKGROUND OF THE DISCLOSURE

The present disclosure generally relates to a cooking appliance, and more specifically, to a deflector for a cooking appliance. Cooking appliances, such as ovens, have cooking cavities which are heated to cook food. The heat from the cooking cavity can cause the oven door to heat, which can result in portions of the outside of the door having an elevated temperature. This can be a concern for consumer touch points on the door as well as dissipation of heat to surrounding components in the cooking appliances. Vent systems have been used to draw air into and/or air to exit the door assembly to potentially help regulate the temperature of the door. However, such arrangements can still result in portions of the door having elevated surface temperatures. Thus, providing an improved vent system to help efficiently draw air into and allow air to exit the door assembly to provide a more uniform exterior surface temperature of the cooking appliance door would be advantageous.

SUMMARY OF THE DISCLOSURE

One aspect of the present disclosure is a cooking appliance with a housing having an upper portion and a bottom portion and a door operably coupled to the housing. The door includes a front portion with a plurality of panels with channels between the panels of the door. A ventilation assembly is coupled to the door proximate to the bottom portion of the housing and draws cool air through the channels defined by the panels of the door. A deflector is coupled to the door near the upper portion of the housing. The deflector includes a first fin adjacent to the front portion of the door and a second fin that defines a circulation space. The second fin includes a central fin extending from a body of the second fin. The first fin and the second fin of the deflector define a restricted opening that is fully coupled with the ventilation assembly by the channels.

Another aspect of the present disclosure is a circulation assembly for a cooking appliance. The circulation assembly includes a plurality of panels defining cool air channels. A first deflector fin is located proximate to a front panel of the plurality of panels and includes a first directing flange, the first directing flange in the front panel defining a first restricted opening proximate the first cool air channel of the plurality of panels. The circulation assembly includes a second deflector fin coupled to one of the other of the plurality of panels. The second deflector fin includes an angular body with a second directing flange. The angular body defines a circulation space between the plurality of panels and includes a central fin configured to regulate cool air within the circulation space.

According to yet another aspect of the present disclosure is a door for a cooking appliance. The door includes a plurality of panels that define a plurality of cool air channels. A deflector is operably coupled to the plurality of panels. The deflector includes a first deflector fin and a second deflector fin. The second deflector fin is located proximate a rear panel of the plurality of panels. The second deflector fin includes a central fin that defines a directing flange which, in combination with the first deflector, define a restricted opening for a concentrated cool air stream.

These and other features, advantages, and objects of the present disclosure will be further understood and appreciated by those skilled in the art by reference to the following specification, claims, and appended drawings.

Figure 1:
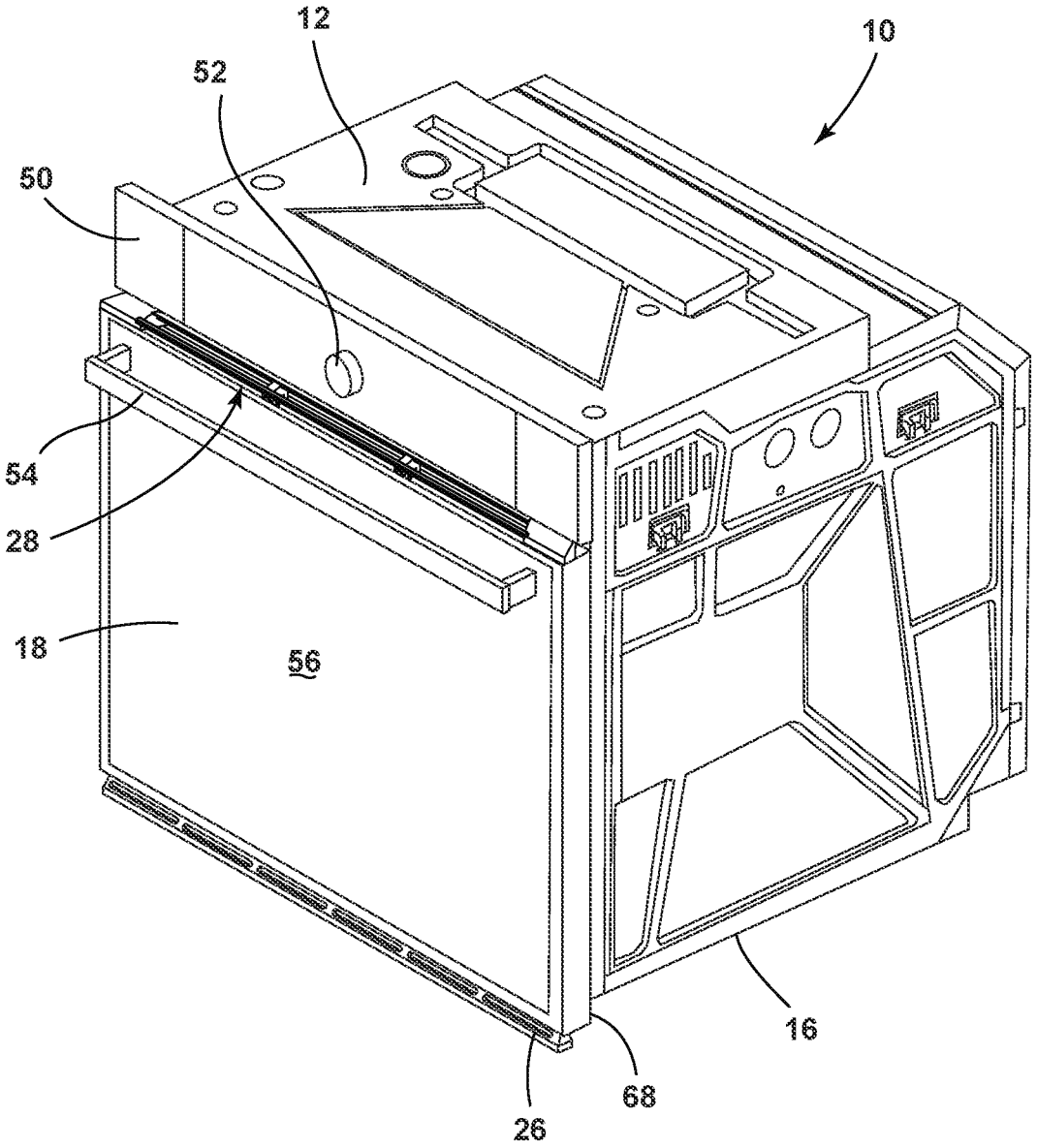
FIG. 1 is a top perspective view of a cooking appliance of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a deflector for a cooking appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-8, reference numeral 10 generally designates a cooking appliance that includes a housing 12 having an upper portion 14 and a bottom portion 16. A door 18 is operably coupled to the housing 12 and includes a front portion 20 and a plurality of panels 22. The door 18 defines a channel 24 between each of the panels 22. A ventilation assembly 26 is proximate to the bottom portion 68 of the door 18 near the bottom 16 of the housing 12 and is configured to draw a cool airflow CA through the channels 24 defined by the door 18. A deflector 28 is operably coupled to the door 18 proximate to the upper portion 14 of the housing 12. The deflector 28 includes a first fin 30 that is proximate to the front portion 20 of the door 18. The deflector 28 also includes a second fin 32 that defines a circulation space 34. The second fin 32 includes a central fin 36 that extends from a body 38 of the second fin 32. The first fin 30 and the second fin 32 define a restricted opening 40 that is fluidly coupled with the ventilation assembly 26 via the channels 24.

The cooking appliance 10 is illustrated in FIGS. 1-8 as a wall-mounted oven. It is also contemplated that the deflector 28, described herein may be utilized with other cooking appliances 10 including, but not limited to, standalone ovens and ranges. The cooking appliance 10 includes the housing 12 with a user interface 50 operably coupled to the housing 12 proximate to the door 18. The user interface 50 includes user controls 52 configured to operate and generally manipulate various cooking processes of the cooking appliance 10. The door 18 of the cooking appliance includes a handle 54 operably coupled to an exterior surface 56 of the door 18, such that the user may translate the door 18 between open and closed positions via the handle 54. Stated differently, the door 18 provides selective access to a cooking cavity 58 of the cooking appliance 10 as the door 18 is operable between open and closed positions. It is generally contemplated that the exterior surface 56 of the door 18 defines the front portion 20 of the door 18.

The door 18 engages the housing 12 in the closed position, and the housing 12 includes a gasket 60 proximate to the door 18 to define a seal between the door 18 and the housing 12. It is further contemplated that the front portion 20 of the door 18 may correspond to and/or be referred to as a front panel of the door 18. It is generally contemplated that the front panel 20 is separate from the plurality of panels 22, such that the front panel 20 is at least partially defined by the exterior surface 56 of the door 18. The configuration of the front panel 20 and the plurality of panels 22 is described in more detail below.

Figure 2:
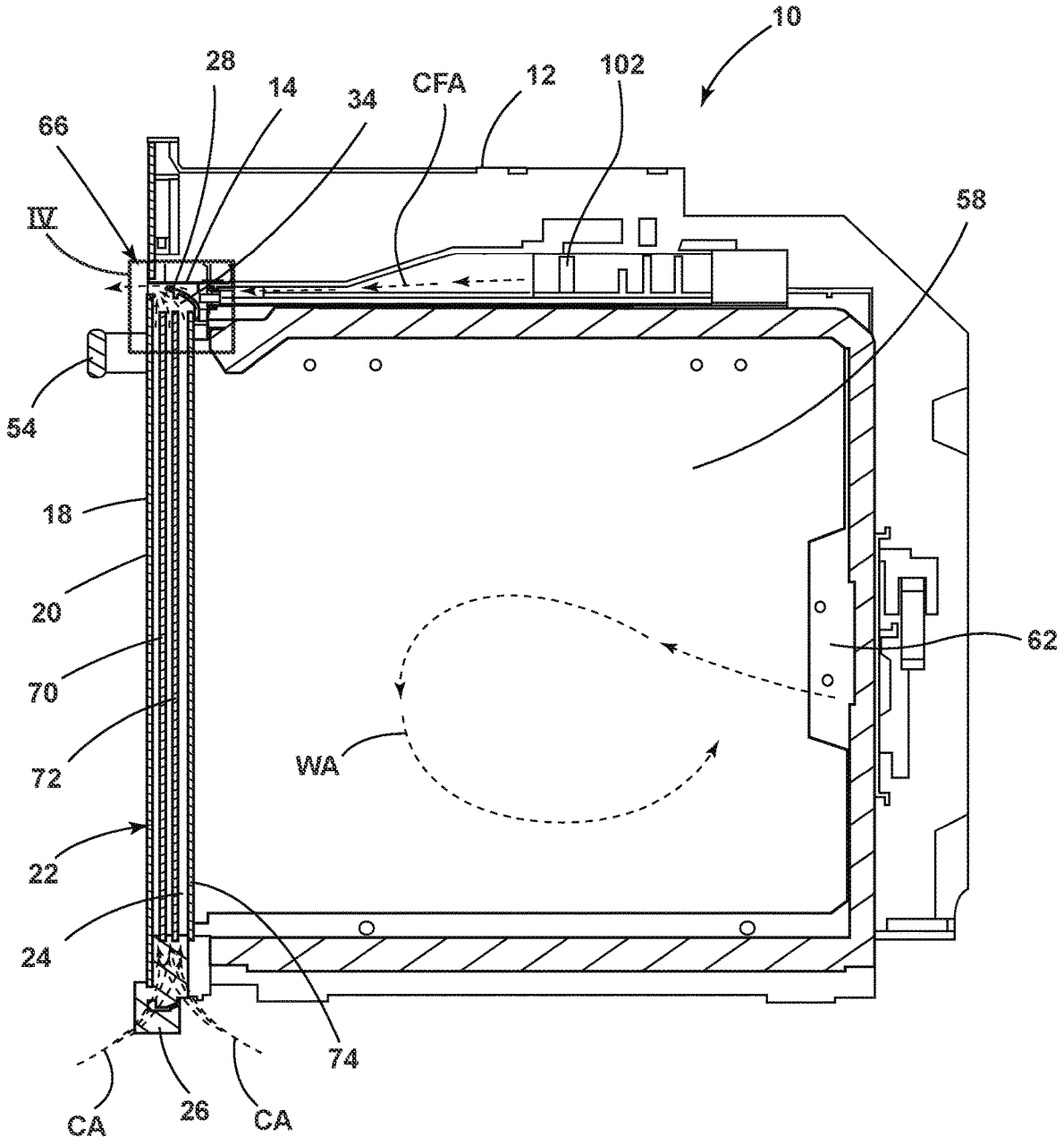
FIG. 2 is a side elevational cross-sectional view of a cooking appliance with a circulation assembly of the present disclosure.
Figure 3:
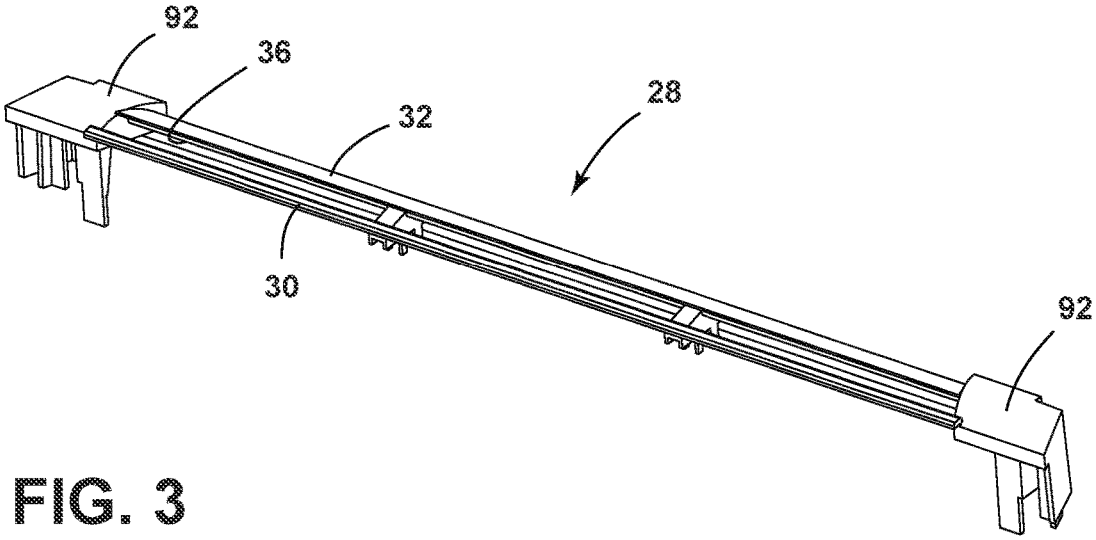
FIG. 3 is a top perspective view of a deflector of the present disclosure.

With further reference to FIGS. 1-3, the cooking appliance 10 also includes a fan 62 that is surrounded by or located adjacent to at least one heating element configured to circulate a warm airflow WA within the cooking cavity 58 during a cooking cycle of the cooking appliance 10. The warm airflow WA may pass through the cooking cavity 58 proximate the upper portion of the housing 12. As described in more detail below, the deflector 28 and the ventilation assembly 26 utilize the cool airflow CA to counterbalance the warm airflow WA from the cooking cavity 58. It is contemplated that the deflector 28 and the ventilation assembly 26 may be collectively referred to as a circulation assembly 66 of the door 18.

The circulation assembly 66 regulates the surface temperature of the door 18 which can be shown in a thermal map of the door 18. The ventilation assembly 26 draws in the cool airflow CA via a bottom 68 of the door 18 to be dispersed throughout one or more of the channels 24. The ventilation assembly 26 is operably coupled to the door 18 proximate to the bottom portion 16 of the housing 12. The ventilation assembly 26 is configured to draw the cool airflow CA through one or more of the channels 24 defined by the plurality of panels 22 of the door 18 and cooperates with the deflector 28, as described in more detail below. The deflector 28 is configured to further balance the cool airflow CA throughout the channels 24 via the first and second fins 30, 32, as described below. The deflector 28 is operably coupled to the door 18 proximate to the upper portion 14 of the housing 12 at an opposing end of the door 18 from the ventilation assembly 26. It is generally contemplated that the deflector 28 is at least partially disposed over the plurality of panels 22 to define the circulation space 34.

Figure 4:
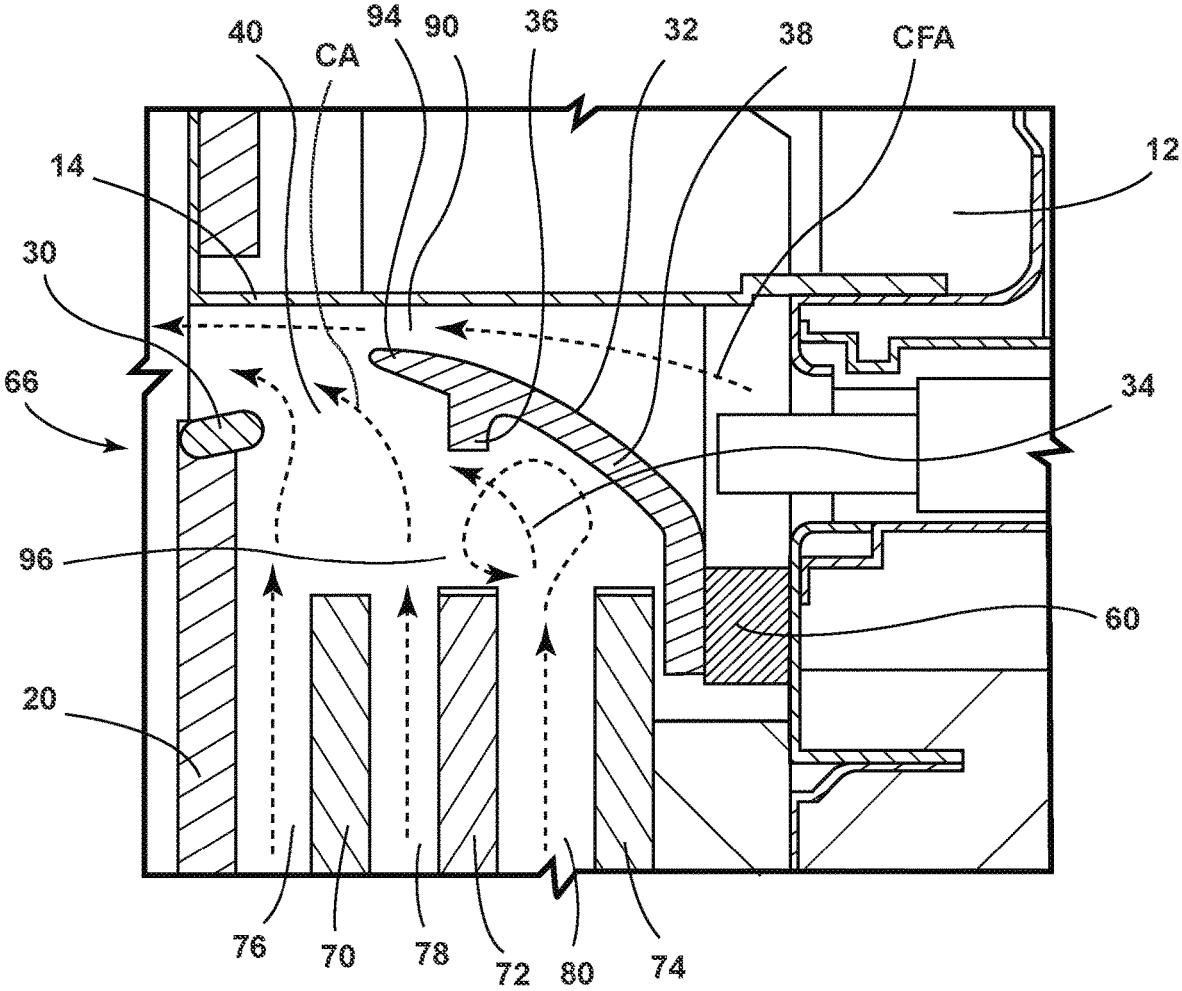
FIG. 4 is an enlarged partial side elevational cross-sectional view of the circulation assembly of FIG. 2 taken at area IV.

With reference now to the embodiment illustrated in FIGS. 2-4, the plurality of panels 22 of the door 18 include the front panel 20, first and second central panels 70, 72, and a rear panel 74. Additionally or alternatively, the door 18 may include more than two central panels and/or less than two central panels depending on the configuration of the door 18. It is also contemplated that the width of the channels 24 may vary depending on the configuration of the door 18 to further assist in regulating the cool airflow CA within the channels 24. The front panel 20 and the first central panel 70 define a first channel 76, and the first and second central panels 70, 72 define a second channel 78. A third channel 80 is defined between the rear panel 74 and the second central panel 72. It is generally contemplated that the first, second, and third channels 76, 78, 80 may collectively be defined as the channels 24 and/or the cool air channels 24 mentioned above. As with the plurality of panels 22, it is contemplated that more than and/or fewer than three channels may be utilized for the door 18. In addition, not all spaces in between individual panels 22 need to be open for use as cool air channels 24.

The channels 24 are fluidly coupled with the ventilation assembly 26 and the deflector 28 of the cooking appliance 10 as part of the circulation assembly 66. The cool airflow CA can be directed through each of the channels 24 from the ventilation assembly 26 toward the deflector 28 to define circulation within the door 18. A venturi passage 90 is defined between the deflector 28 and the upper portion 14 of the cooking appliance 10. Airflow through the venturi passage 90 generates a localized air pressure drop, which encourages movement of the cool airflow CA from the circulation assembly 66. For example, the venturi passage 90 allows the airflow CA to move from the bottom to the top of the channels 24 of door 18. While the single restricted opening 40 encourages an increase in pressure of the cool airflow CA, the venturi passage 90 defines a low pressure stream of airflow.

With further reference to FIGS. 2-4, the deflector 28 includes the first fin 30, the second fin 32, and end caps 92 that operably couple the deflector 28 to the door 18. The deflector 28 may couple to the door 18 via a snap-fit configuration between the end caps 92 and the plurality of panels 22. The deflector 28 generally extends along a length L of the door 18 adjacent to the handle 54. The deflector 28 assists in regulating the surface temperature of the external surface 56 of the front panel 20, as described further below. The deflector 28 is positioned proximate to the upper portion 14 of the housing 12. The venturi passage 90 is defined between the deflector 28 and the upper portion 14 of the cooking appliance 10 through which the airflow may pass toward the door 18.

The venturi passage 90 is partially defined by the deflector 28, such that the second fin 32 of the deflector 28 extends toward the upper portion 14 of the housing 12 to narrow the space between the second fin 32 and the housing 12 to define the venturi passage 90. It is generally contemplated that the first and second fins 30, 32 may be referred to as a first deflector fin and a second deflector fin, respectively. As illustrated in FIG. 4, the first fin 30 is proximate to the front panel 20 of the door 18 and at least partially extends over the first channel 76. The second fin 32 is operably coupled to the door 18 proximate to the rear panel 74. It is generally contemplated that the second fin 32 may at least partially extend over each of the second and third channels 78, 80 to define the restricted opening 40.

As mentioned above, the second fin 32 includes the central fin 36 extending from the body 38 of the second fin 32. The central fin 36 generally extends toward the second central panel 72 of the plurality of panels 22 and defines a directing flange 94 of the second fin 32. The directing flange 94 further defines the venturi passage 90 along with the housing 12, as mentioned above. As illustrated in FIG. 4, the body 38 of the second fin 32 has as a generally arcuate configuration, and the directing flange 94 extends toward the upper portion 14 of the cooking appliance 10. The arcuate configuration of the body 38 may generally assist in guiding the warm airflow to the venturi passage 90.

With further reference to FIGS. 2-4, the directing flange 94 and the first fin 30 generally extend toward one another to define the restricted opening 40 through which the cool air from each of the channels 24 may be directed. The directing flange 94 and the first fin 30 narrow the restricted opening 40 through which the cool air may be directed, such that the circulation space 34 is generally defined between the first and second fins 30, 32 and each of the plurality of panels 22. The cool air from the channels 24 may be collected and generally recirculated within the circulation space 34, which may be further facilitated by the central fin 36. A gap 96 is defined between the central fin 36 and the second central panel 72, such that the cool airflow CA may fully circulate within the circulation space 34 while generally directed within the space 34. It is generally contemplated that the gap 96 along with the central fin 36 assists in rebalancing the cool airflow CA within each of the channels 24, such that there is an increased distribution of the cool airflow CA within the third channel 80.

Figure 7:
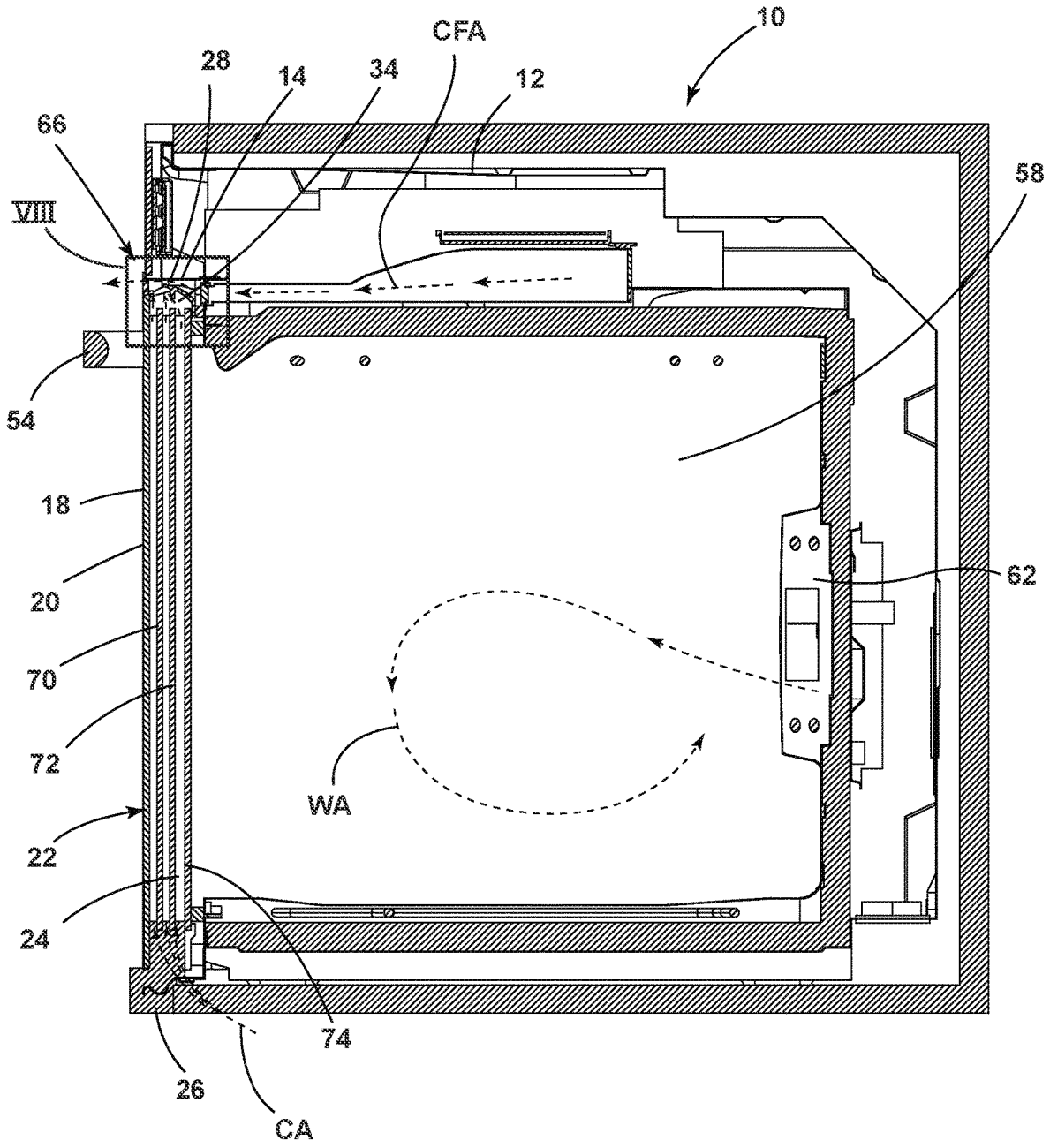
FIG. 7 is a side elevational cross-sectional view of a cooking appliance with a circulation assembly of the present disclosure.
Figure 8:
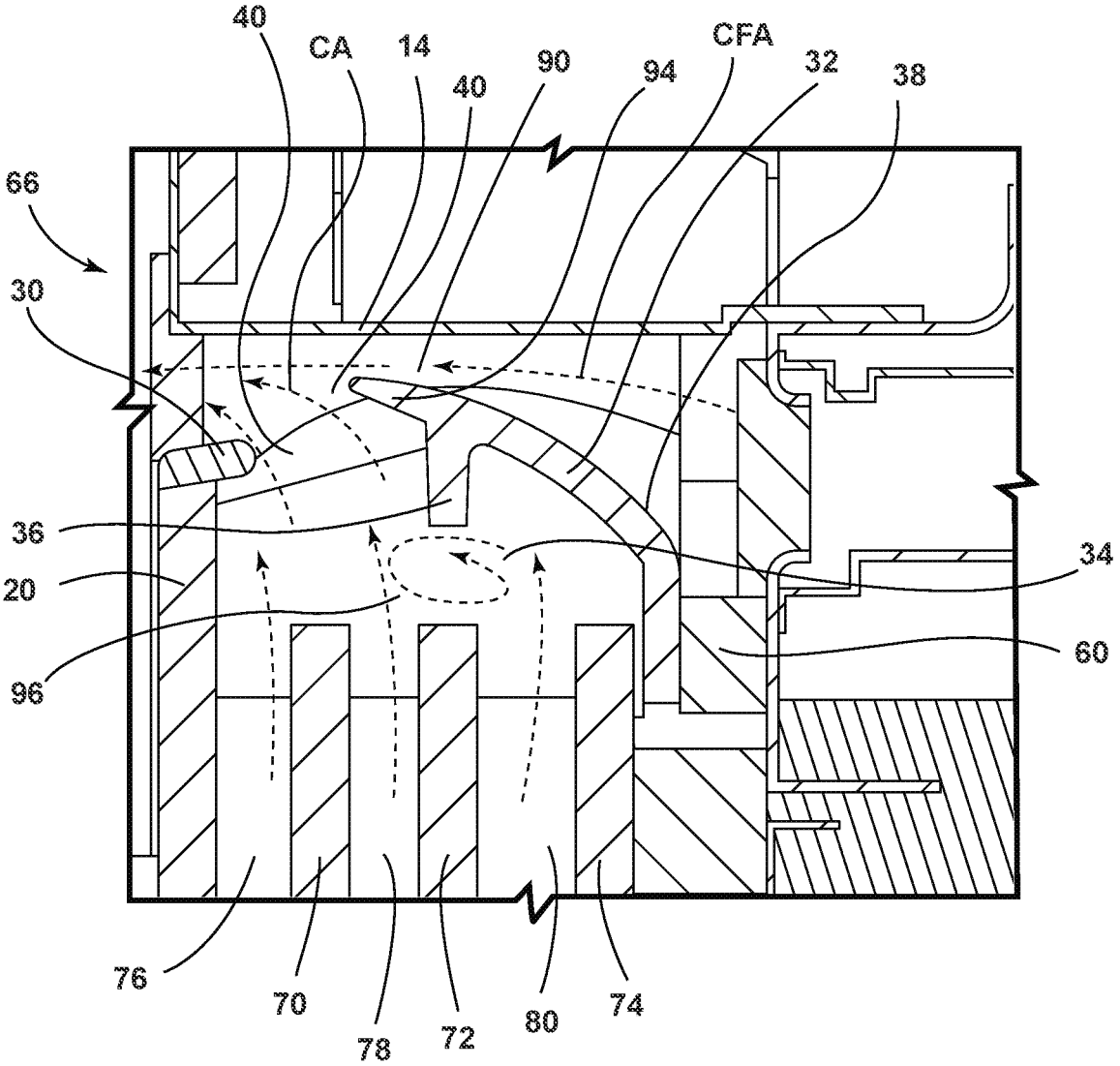
FIG. 8 is an enlarged partial side elevational cross-sectional view of the circulation assembly of FIG. 7 taken at area VIII.

By way of example, and not limitation the gap 96 between the central fin 36 and the second central panel 72 may be approximately 10 millimeters in the embodiment illustrated in FIGS. 2-4. It is also contemplated that the gap 96 may be greater than 10 millimeters and/or less than 10 millimeters depending on the configuration of the door 18. For example, the door 18 may include more than three channels 24, which may result in an adjustment of the length of the central fin 36 to regulate the cool airflow CA distribution in each of the channels 24 to maintain a cool thermal map of the door 18. As described in more detail below, the gap 96 defined between the central fin 36 and the second central panel 72 assists in redirecting the cool airflow CA toward the third channel 80. The redirection of the cool airflow CA within the third channel 80 generally minimizes, or cools, the surface temperature along the front panel 20 and/or the exterior surface 56 of the door 18, as described in more detail below. FIGS. 7-8 illustrate a longer central fin 36 with a smaller gap 94 compared to the embodiments shown in FIGS. 2-4.

Figure 5:
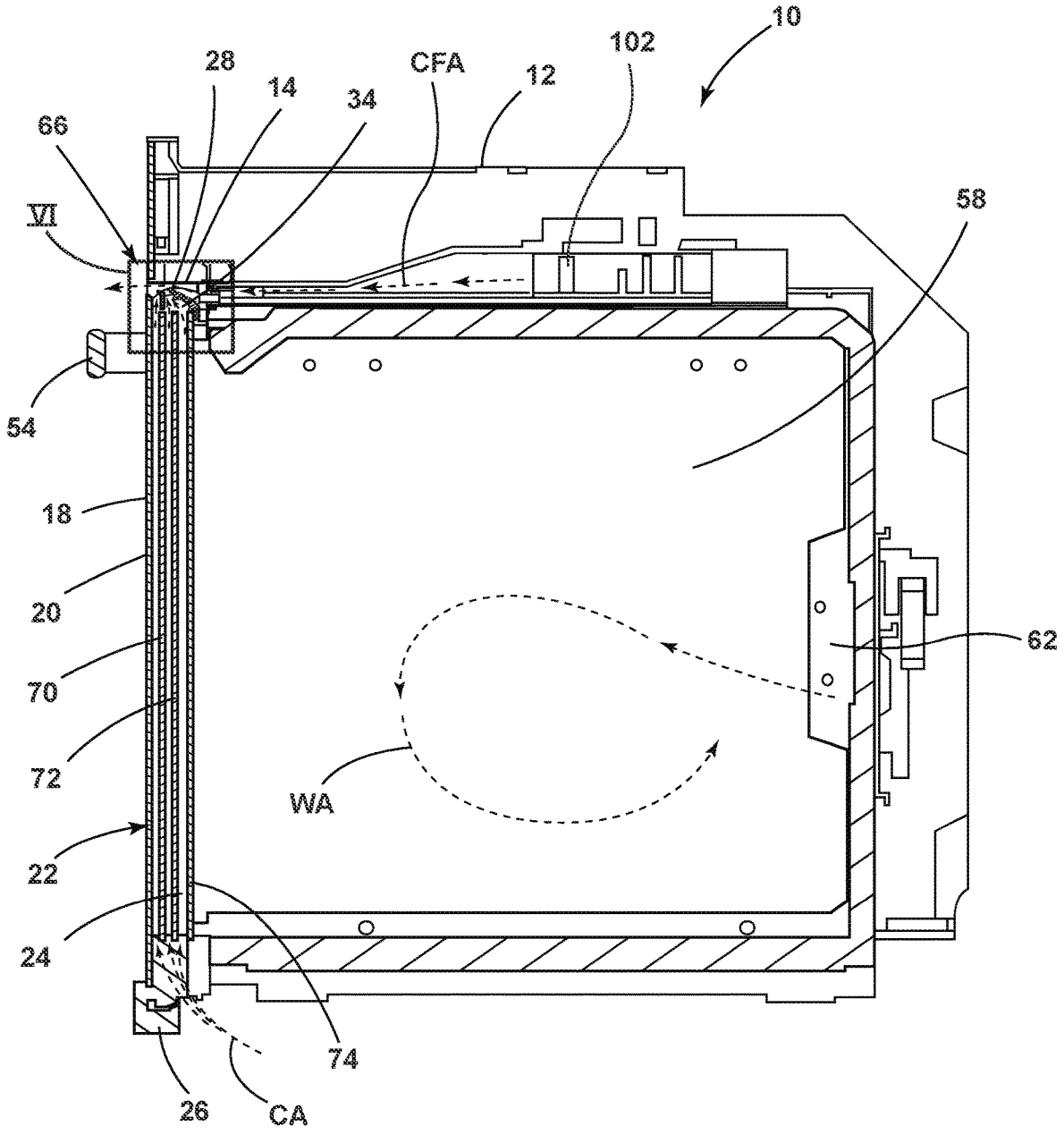
FIG. 5 is a side elevational cross-sectional view of a cooking appliance with a circulation assembly of the present disclosure.
Figure 6:
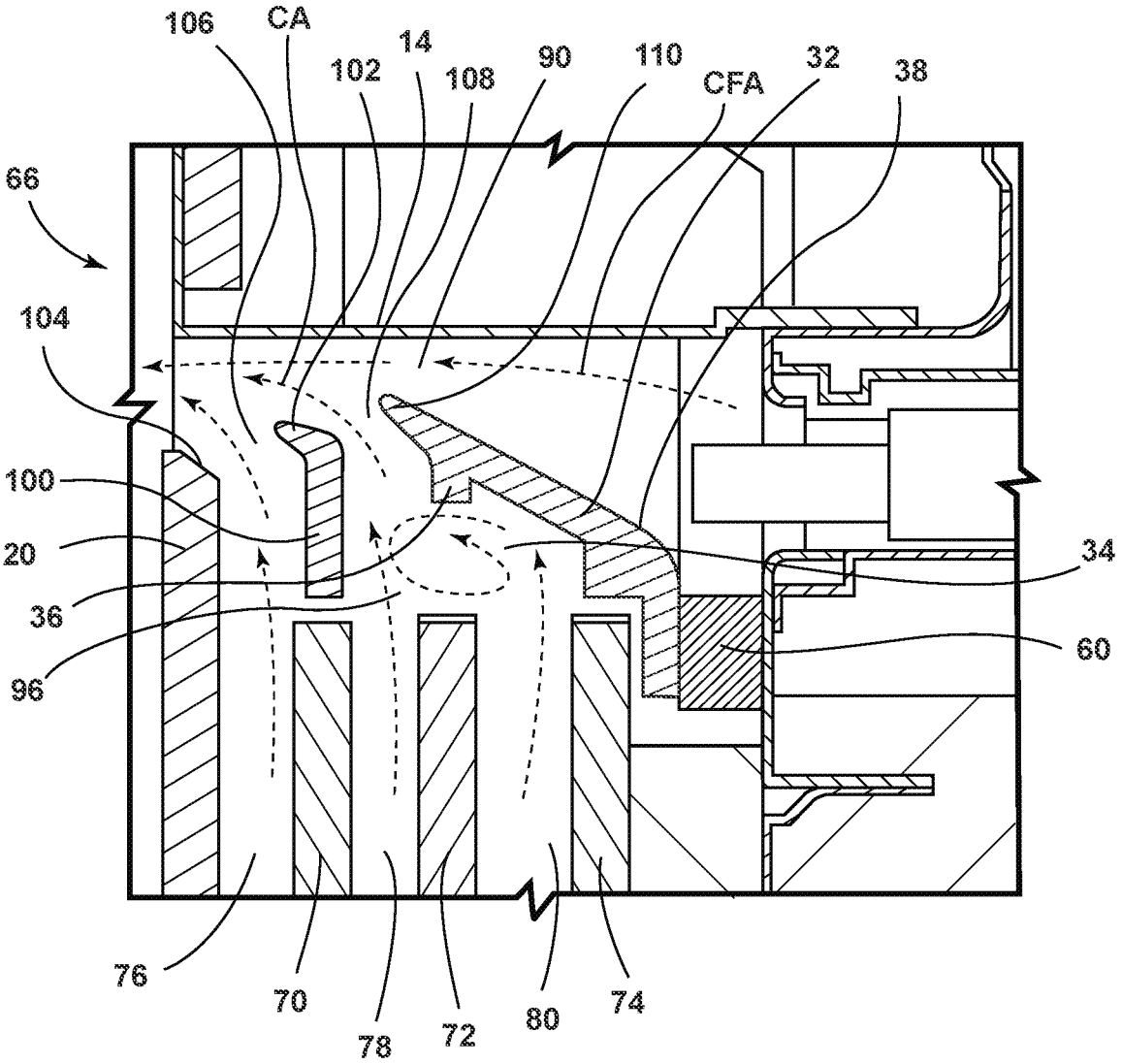
FIG. 6 is an enlarged partial side elevational cross-sectional view of the circulation assembly of FIG. 5 taken at area VI.

With reference to FIGS. 5-6, the deflector 28 is illustrated as including the first deflector fin 30 above the first central panel 70 and the second deflector fin 32 extending over each of the rear panel 74 and the second central panel 72. As illustrated in FIG. 6, the first deflector fin 30 includes a linear body 100 and a first directing flange 102 angularly extending from the linear body 100 toward the front panel 20 of the cooking appliance 10. It is generally contemplated that the front panel 20 may include an angled edge 104, such that the angled edge 104 of the front panel 20 and the first directing flange 102 may define a first restricted opening 106. The first and second deflector fins 30, 32 generally define a second restricted opening 108 through which the cool airflow CA may pass. The body 38 of the second deflector fin 30, as illustrated in FIG. 6, has an angular configuration and includes the central fin 36. The angular body 38 of the second deflector fin 32 may define a more direct change in space between the deflector 28 and the upper portion 14 of the housing 12. The linear body 100 of the first deflector fin 30 provides an extension of the first central panel 70 to further assist in redirecting the cool airflow CA toward the third channel 80 and ultimately toward the second restricted opening 108.

As similarly discussed above, the second restricted opening 108 defined by the second deflector fin 32 generally rebalances the cool airflow CA within each of the channels 24. The central fin 36 defines a second directing flange 110 of the second deflector fin 32, which may be generally angled toward the first deflector fin 30, as mentioned above. The first and second restricted openings 104, 108 assist in forceful disbursement of the cool airflow CA toward the upper portion 14 of the housing 12. The first and second directing flanges 102, 110 further assist in directing the cool airflow CA and defining the first and second restricted openings 104, 108, respectively.

Referring again to FIGS. 1-8, the configurations of the first and second fins 30, 32 of the deflector 28 define the circulation space 34 above the plurality of panels 22. The circulation space 34 assists in adjusting the cool airflow CA within the channels 24, such that the thermal map of the external surface 56 of the door 18 remains cool. In operation, the ventilation assembly 26 draws in the cool airflow CA from exterior to the cooking appliance 10 while the fan 62 circulates the warm airflow WA within the cooking cavity 58. Airflow CFA from a cooling fan 102 may at least partially exit the housing 12 via the venturi passage 90 defined between the upper portion 14 of the housing 12 and the deflector 28.

The cool airflow CA drawn in by the ventilation assembly 26 is drawn through the channels 24 defined by the plurality of panels 22 toward the deflector 28. While the cool airflow CA passes through each of the channels 24, it is generally contemplated that the cool airflow CA may have a varying rate through each of the channels 24. The circulation space 34 defined by the second fin 32 of the deflector 28 and the central fin 36 assist in balancing the distribution of the cool airflow CA through each of the channels 24. For example, the central fin 36 and the circulation space 34 recirculate the cool airflow CA through the third channel 80, which maximizes the cooling effect along each of the plurality of panels 22. The resulting cooling effect ultimately results in a cooled, or minimized, thermal map defined along the exterior surface 56 of the door 18.

With further reference to FIGS. 4, 6, and 8, it is generally contemplated that the third channel 80 may have a width that is greater than a width of either of the first and second channels 76, 78. The greater width of the third channel 80 may further assist in the cooling effect along each of the plurality of panels 22 to ultimately cool the door 18. Stated differently, the cool airflow CA passing through each of the channels 24 minimizes the presence of hotspots or other warm zones along the exterior surface 56 of the door 18. The restricted opening 40 defined by the deflector 28 further maximizes the cooling affect along the door 18 by concentrating the flow path of the cool airflow CA toward the upper portion 14 of the housing 12. The single restricted opening 40 illustrated in FIG. 4 still further maximizes the cooling affect by restricting the path that the cool airflow CA can pass.

The invention disclosed herein is further summarized in the following paragraphs and is further characterized by combinations of any and all of the various aspects described therein.

According to another aspect of the present disclosure, a cooking appliance has a housing with an upper portion and a bottom portion. A door is operably coupled to the housing and includes a front portion and a plurality of panels, the door defining a channel between each of the channels. A ventilation assembly is located proximate the bottom portion of the housing and configured to draw cool air through the channels defined by the door. A deflector is operably coupled to the door proximate the upper portion of the housing. The deflector includes a first fin proximate the front portion of the door and a second fin that defines a circulation space. The second fin includes a central fin extending from a body of the second fin. The first fin and second fin define a restricted opening fluidly coupled with the ventilation assembly via the channels.

According to another aspect, the body of the second fin is arcuate and defines a venturi space between a deflector and the upper portion of the housing of the cooking appliance.

According to another aspect, the second fin includes a directing flange extending toward the upper portion of the body to further define the venturi space.

According to another aspect, the venturi space is configured to direct a warm airflow from the housing and the cool air is directed into the warm airflow by the directing flange and the first fin.

According to another aspect, the cool air from the ventilation assembly is concentrated in the restricted opening and translated toward the upper portion of the housing via the directing flange of the second fin.

According to another aspect, the central fin defines a uniform temperature along the door proximate the upper portion of the housing.

According to another aspect, the plurality of panels includes central panels and a rear panel. The central fin of the deflector increases a flow rate of cool air within a channel defined between one of the central panels and the rear panel.

According to another aspect of the present disclosure, a circulation assembly for a cooking appliance has a plurality of panels defining cool air channels. The cooking appliance also has a first deflector fin proximate the front panel of the plurality of panels. The first deflector fin includes a first directing flange which, with the front panel, defines a first restricted opening proximate a first cool air channel of the plurality of panels. A second deflector fin is coupled to one of the plurality of panels and includes an angular body with a second directing flange. The angular body defines a circulation space between a plurality of panels and includes a central fin configured to regulate cool air within the circulation space.

According to another aspect, the second restricted opening is defined between the first deflector fin and the second deflector fin. Cool air within the circulation space is configured to exit via the second restricted opening.

According to another aspect, the cool air channels include a rear channel. An increased cool air flow is defined within the rear channel via the central fin of the second deflector fin.

According to another aspect, the circulation space is defined between the plurality of panels and the angular body of the second deflector fin. Cool air is received within the circulation space.

According to another aspect, the central fin of the second deflector fin further defines a circulation space.

According to another aspect, the second directing flange and the first deflector fin define the second restricted opening.

According to another aspect, the central fin helps redistribute airflow among the door channels which affects the surface temperature of the door panels.

According to another aspect of the present disclosure, a door for a cooking appliance includes a plurality of panels defining cool air channels. A deflector is operably coupled to the plurality of panels. The deflector includes a first deflector fin and a second deflector fin. The second deflector fin is located proximate a rear panel of the plurality of panels of the door. The second deflector fin includes a central fin that defines a directing flange. The directing flange and the first deflector fin define a restricted opening that defines a concentrated cool air stream.

According to another aspect, the first deflector extends over a front panel of the plurality of panels and toward the directing flange of the second deflector fin.

According to another aspect, the first deflector is proximate a first central panel of the plurality of panels. The second deflector fin extends over a rear panel and a second central panel of the plurality of panels to define a circulation space between the first deflector fin, the second deflector fin, and the plurality of panels.

According to another aspect, a rear cool air channel is defined between the second central panel and the rear panel. A flow of the cool air stream within the rear cool air channel is greater than the flow of the cool air stream within the cool air channels defined between the front panel and the first central panel of the door.

According to another aspect, the circulation space is defined between the central fin of the second deflector fin and the plurality of panels.

According to another aspect, the central fin helps redistribute airflow among the door channels which affects the surface temperature of the door panels.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cooking appliance, comprising:

a housing having an upper portion and a bottom portion;

a door operably coupled to the housing and including a front portion and a plurality of panels, the door defining a channel between each of the panels;

a ventilation assembly proximate the bottom portion of the housing and configured to draw cool air through the channels defined by the door; and a deflector operably coupled to the door proximate the upper portion of the housing, the deflector including:

a first fin proximate the front portion of the door; and a second fin defining a circulation space and including a central fin extending from a body of the second fin, the first fin and the second fin defining a restricted opening fluidly coupled with the ventilation assembly via the channels; and wherein the central fin re-distributes air among the plurality of the channels.

2. The cooking appliance of claim 1, wherein the body of the second fin is arcuate and defines a venturi space between the deflector and the upper portion of the housing.

3. The cooking appliance of claim 2, wherein the second fin includes a directing flange extending toward the upper portion of the body, and wherein the directing flange further defines the venturi space.

4. The cooking appliance of claim 3, wherein the venturi space is configured to direct a warm air flow from the housing, and wherein the cool air is directed into the warm air flow via the directing flange and the first fin.

5. The cooking appliance of claim 3, wherein the cool air from the ventilation assembly is concentrated in the restricted opening and translated toward the upper portion of the housing via the directing flange of the second fin.

6. The cooking appliance of claim 1, wherein the plurality of panels include central panels and a rear panel, and wherein the central fin of the deflector increases a flow rate of cool air within the channel defined between one of the central panels and the rear panel.

7. A circulation assembly for a cooking appliance, comprising:

a plurality of panels defining cool air channels;

a first deflector fin proximate a front panel of the plurality of panels and including a first directing flange, the first directing flange and the front panel defining a first restricted opening proximate a first cool air channel of the plurality of panels;

a second deflector fin coupled to one of the plurality of panels and including an angular body and a second directing flange, the angular body defining a circulation space between the plurality of panels and including a central fin configured to regulate cool air within the circulation space; and wherein a second restricted opening is defined between the first deflector fin and the second deflector fin, and wherein the cool air within the circulation space is configured to exit via the second restricted opening.

8. The circulation assembly of claim 7, wherein the cool air channels include a rear channel, and wherein an increased cool air flow is defined within the rear channel via the central fin.

9. The circulation assembly of claim 7, wherein the circulation space is defined between the plurality of panels and the angular body of the second deflector fin, and wherein the cool air is received within the circulation space.

10. The circulation assembly of claim 7, wherein the central fin of the second deflector fin further defines the circulation space.

11. The circulation assembly of claim 7, wherein the second directing flange and the first deflector fin define the second restricted opening.

12. The circulation assembly of claim 7, wherein the central fin re-distributes air among the plurality of the channels.

13. A door for a cooking appliance, comprising:

a plurality of panels defining cool air channels; and a deflector operably coupled to the plurality of panels, the deflector including:

a first deflector fin;

a second deflector fin proximate a rear panel of the plurality of panels, the second deflector fin including a central fin that defines a directing flange, wherein the directing flange and the first deflector fin define a restricted opening that defines a concentrated cool air stream; and wherein the first deflector extends over a front panel of the plurality of panels and toward the directing flange of the second deflector fin.

14. The door of claim 13, wherein the first deflector is proximate a first central panel of the plurality of panels, and wherein the second deflector fin extends over a rear panel and a second central panel of the plurality of panels to define a circulation space between the first deflector fin, the second deflector fin, and the plurality of panels.

15. The door of claim 14, wherein a rear cool air channel is defined between the second central panel and the rear panel, and wherein a flow of the cool air stream within the rear cool air channel is greater than a flow of the cool air stream within the cool air channels defined between a front panel and the first central panel.

16. The door of claim 13, wherein a circulation space is defined between the central fin of the second deflector fin and the plurality of panels.

17. The door of claim 13, wherein the central fin redistributes air among the plurality of the channels.

* * * * *